US011789379B2

(12) United States Patent
Iwase

(10) Patent No.: US 11,789,379 B2
(45) Date of Patent: Oct. 17, 2023

(54) IMAGE FORMING APPARATUS WHICH CONTROLS THE MOVEMENT OF A TONER CARTRIDGE DURING ATTACHING AND DETACHING OF THE TONER CARTRIDGE FROM THE IMAGE FORMING APPARATUS

(71) Applicant: CANON KABUSHIKI KAISHA, Tokyo (JP)

(72) Inventor: Masaki Iwase, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/681,552

(22) Filed: Feb. 25, 2022

(65) Prior Publication Data

US 2022/0276585 A1 Sep. 1, 2022

(30) Foreign Application Priority Data

Feb. 26, 2021 (JP) ..... 2021-030081

(51) Int. Cl.
*G03G 15/08* (2006.01)
*G03G 21/16* (2006.01)

(52) U.S. Cl.
CPC ..... *G03G 15/0886* (2013.01); *G03G 15/0875* (2013.01); *G03G 21/1633* (2013.01);
(Continued)

(58) Field of Classification Search
CPC ..... G03G 15/0886; G03G 15/0865; G03G 15/0875; G03G 21/1633; G03G 21/1676; G03G 2215/0692; G03G 2215/066; G03G 2215/068; G03G 2221/163; G03G 2221/1684
(Continued)

(56) References Cited

U.S. PATENT DOCUMENTS 10,139,752 B2 * 11/2018 Murata ..... G03G 15/0865
2002/0085857 A1 * 7/2002 Kim ..... G03G 15/0865 399/119
(Continued)

FOREIGN PATENT DOCUMENTS

EP 604991 A2 * 7/1994 ..... G03G 15/0855
JP 2013190586 A 9/2013
(Continued)

*Primary Examiner* — Robert B Beatty
(74) *Attorney, Agent, or Firm* — Canon U.S.A., Inc. I.P. Division

(57) ABSTRACT

An image forming apparatus includes a toner cartridge including a toner container with a supplying outlet and an engaged portion, and a shutter movable between an open position and a closed position, and an apparatus main body to and from which the toner cartridge is mounted and detached, the apparatus main body including a toner accommodation unit, a guide portion for guiding the toner cartridge, a pressing member pressing the toner cartridge in the detaching direction, an engaging member movable between an engaging position and an engagement release position, the engaging member allowing movement of the toner cartridge from the first position toward the second position in a case where the engaging member is at the engagement release position, and a damping force applying mechanism applying damping force to the toner cartridge.

12 Claims, 12 Drawing Sheets

(52) U.S. Cl.
CPC ... *G03G 15/0868* (2013.01); *G03G 2215/068* (2013.01); *G03G 2215/0692* (2013.01)

(58) Field of Classification Search
USPC ..... 399/262
See application file for complete search history.

(56) References Cited

U.S. PATENT DOCUMENTS

| | | | | |
|---|---|---|---|---|
| 2012/0257912 | A1* | 10/2012 | Hasebe | G03G 15/0886 399/262 |
| 2012/0263504 | A1* | 10/2012 | Nagashima | G03G 21/1676 399/262 |
| 2013/0078004 | A1* | 3/2013 | Matsumoto | G03G 15/0886 399/260 |
| 2013/0216259 | A1* | 8/2013 | Nakajima | G03G 21/1676 399/119 |
| 2014/0140737 | A1* | 5/2014 | Yamanaka | G03G 21/1676 399/260 |
| 2018/0113416 | A1* | 4/2018 | Ushikubo | G03G 21/1647 |

FOREIGN PATENT DOCUMENTS

| | | | |
|---|---|---|---|
| JP | 5307200 | B2 | 10/2013 |
| JP | 2018185384 | A | 11/2018 |
| JP | 2019159088 | A | 9/2019 |

* cited by examiner

IMAGE FORMING APPARATUS WHICH CONTROLS THE MOVEMENT OF A TONER CARTRIDGE DURING ATTACHING AND DETACHING OF THE TONER CARTRIDGE FROM THE IMAGE FORMING APPARATUS

BACKGROUND OF THE DISCLOSURE

Field of the Disclosure

The present disclosure relates to an electrophotographic image forming apparatus including a toner cartridge.

Description of the Related Art

Regarding a toner cartridge used in an image forming apparatus such as a laser printer, there is known a configuration in which a portion that accommodates toner is separated from a development unit including a development roller and the like, and the portion is made independent as a toner cartridge. The configuration allows replacement of only the toner cartridge in a case where toner runs out, and can thereby achieve a cost reduction.

Japanese Patent No. 5307200 discusses a configuration including a toner cartridge moving unit configured to, in a case where toner in a toner cartridge runs out and a user chooses to replace the toner cartridge, move the toner cartridge from a toner supply position in an apparatus main body to an ejection position on an insertion slot side.

SUMMARY OF THE DISCLOSURE

According to an aspect of the present disclosure, an image forming apparatus includes a toner cartridge including a toner container configured to accommodate toner, the toner container being provided with a supplying outlet and including an engaged portion, and a shutter configured to be movable with respect to the toner container between an open position where the shutter opens the supplying outlet and a closed position where the shutter closes the supplying outlet, and an apparatus main body to and from which the toner cartridge can be mounted and detached, the apparatus main body including a toner accommodation unit configured to accommodate toner supplied from the supplying outlet of the toner cartridge, a guide portion configured to guide the toner cartridge to be movable from a first position toward a second position in a detaching direction of the toner cartridge, the first position being a position where the shutter is at the closed position and the toner cartridge is capable of supplying toner from the supplying outlet to the toner container, the second position being a position where the shutter is at the closed position, the second position being on a downstream side of the first position in the detaching direction, a pressing member configured to press the toner cartridge in the detaching direction, an engaging member configured to be movable between an engaging position where the engaging member is engaged with the engaged portion to restrict movement of the toner cartridge in the detaching direction when the toner cartridge is at the first position and an engagement release position where the engagement of the engaging member with the engaged portion is released, the engaging member being configured to, in a case where the engaging member is at the engagement release position, allow movement of the toner cartridge from the first position toward the second position due to pressing by the pressing member, and a damping force applying mechanism configured to apply damping force to the toner cartridge while the toner cartridge is moved from the first position toward the second position.

Further features of the present disclosure will become apparent from the following description of exemplary embodiments with reference to the attached drawings.

DESCRIPTION OF THE EMBODIMENTS

A first exemplary embodiment of the present disclosure will be described with reference to the accompanying drawings.

<Image Forming Apparatus>

Figure 1:
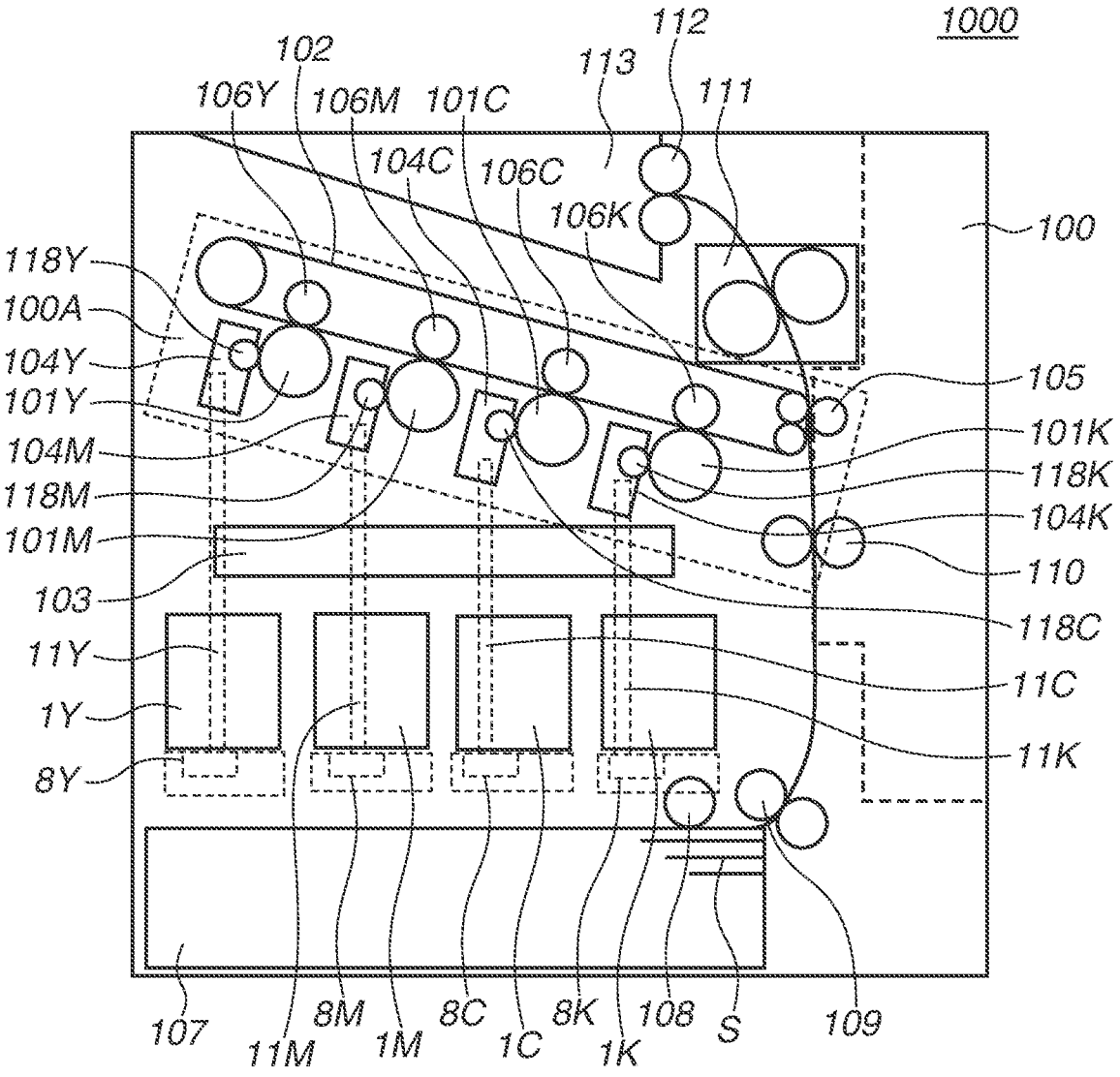
FIG. 1 is a sectional view schematically illustrating an image forming apparatus according to a first exemplary embodiment.

FIG. 1 is a schematic view of an image forming apparatus 1000. The image forming apparatus 1000 is an electrophotographic color laser printer, and includes toner cartridges 1 (1Y, 1M, 1C, and 1K) and an apparatus main body 100 to and from which the toner cartridges 1 can be attached and detached. The apparatus main body 100 includes an image forming unit 100A that forms a toner image on a sheet S. The image forming unit 100A includes photosensitive drums 101, development rollers 118, an intermediate transfer belt 102, primary transfer rollers 106, and a secondary transfer roller 105.

Four photosensitive drums 101, namely photosensitive drums 101Y, 101M, 101C, and 101K, corresponding to four colors, namely yellow, magenta, cyan, and black, respectively, are arranged. Similarly, four development rollers 118, namely development rollers 118Y, 118M, 118C, and 118K, and four primary transfer rollers 106, namely primary transfer rollers 106Y, 106M, 106C, and 106K, are arranged.

When an image forming operation is started in the image forming unit 100A, the photosensitive drums 101 are irradiated with light based on image signals by a laser scanner 103, and electrostatic latent images are formed on the respective photosensitive drums 101. Subsequently, the development rollers 118 in respective four colors are configured to carry toner accommodated in developer containers 104Y, 104M, 104C, and 104K, respectively. Supplying the toner carried by the development rollers 118 to the respective electrostatic latent images on the respective photosensitive drums 101 causes toner images to be developed on the respective photosensitive drums 101.

The toner images formed on the respective photosensitive drums 101 are primarily transferred to the intermediate transfer belt 102. The toner images on the intermediate transfer belt 102 are then conveyed to a secondary transfer unit. When toner in each of the developer containers 104 is consumed, toner is sequentially drawn up from a corresponding one of the toner cartridges 1Y, 1M, 1C, and 1K, and each of the developer containers 104 is refilled with toner.

The sheet S is fed one by one from a sheet storage unit 107 by a pickup roller 108 in conjunction with an operation of the image forming unit 100A. The sheet S is conveyed by a feed roller 109 and a registration roller 110 to the secondary transfer unit, which is a nip portion of the intermediate transfer belt 102 and the secondary transfer roller 105. The toner images are transferred from the intermediate transfer belt 102 to the sheet S by the secondary transfer roller 105 in the secondary transfer unit. The sheet S, to which the toner images are transferred, is thereafter conveyed to a fixing unit 111, and the toner images are heated and pressed by the fixing unit 111 and are thereby fixed to the sheet S. The sheet S, after the fixing, is discharged to a discharge tray by a discharge roller 112.

(Toner Conveyance Configuration)

Figure 2A:
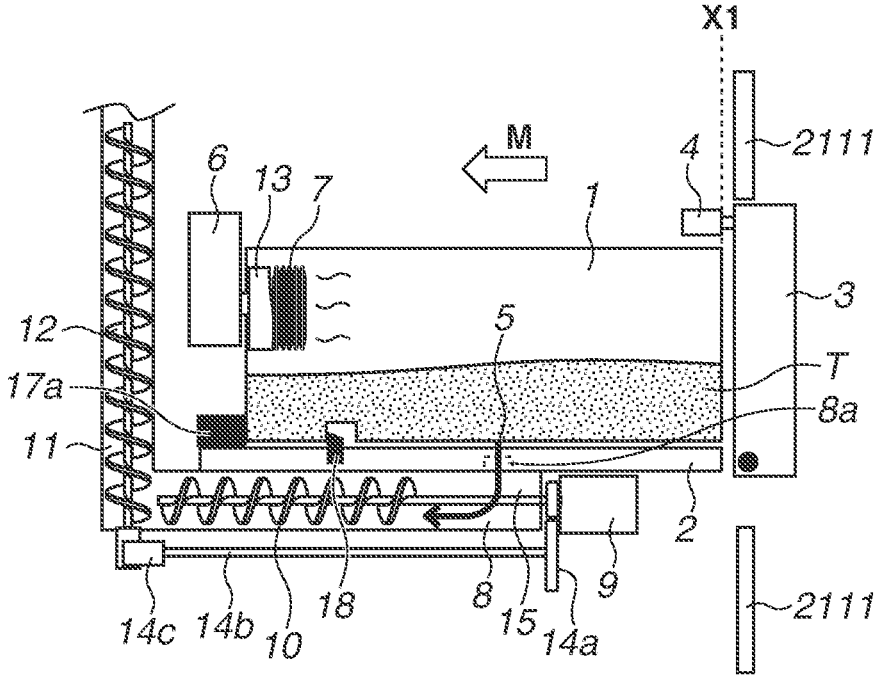
FIGS. 2A and 2B are sectional views schematically illustrating a toner cartridge at a supply position of an apparatus main body and at an ejection position of the apparatus main body, respectively, and the apparatus main body according to the first exemplary embodiment.
Figure 2B:
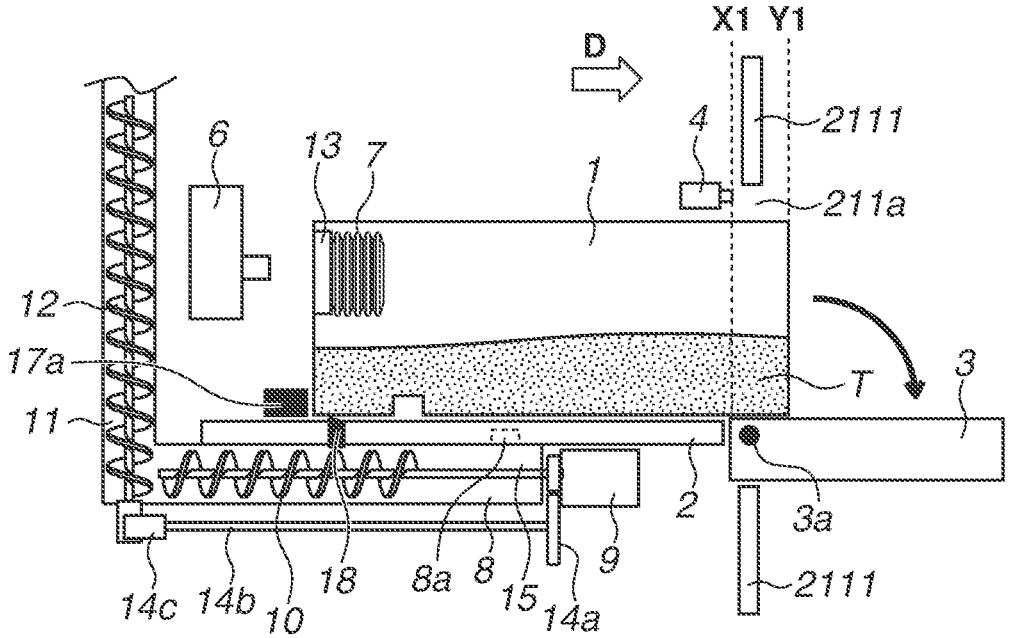

FIG. 2A is a sectional view illustrating a state in which one of the toner cartridges 1 is mounted at a supply position X1 (first position) of the apparatus main body 100. FIG. 2B is a sectional view illustrating a state in which a door 3 is opened, and the toner cartridge 1 is at an ejection position Y1 (second position)

The toner cartridge 1 is configured so that the toner cartridge 1 can be mounted on the apparatus main body 100 in a mounting direction M and can be detached in a detaching direction D. The mounting direction M and the detaching direction D are parallel to a rotational axis direction of the photosensitive drum 101 and mutually opposite directions.

The apparatus main body 100 includes the door 3, a door sensor 4 (opening/closing sensor), a guide portion 2, toner conveyance pipes 8 and 11, toner conveyance screws 10 and 12, a cartridge driving motor 6, a main body driving motor 9, and a driving unit 14. The apparatus main body 100 includes a frame 2111 provided with an opening 211*a* for attaching and detaching the toner cartridge 1.

The door 3 is an opening/closing member that opens and closes the opening 211*a* provided in the frame 2111 illustrated in FIG. 2B. The opening 211*a* is provided to attach and detach the toner cartridge 1 to and from the apparatus main body 100. The door 3 is configured so as to pivot about a hinge 3*a* and is shared by the four toner cartridges 1 (1Y, 1M, 1C, and 1K). More specifically, opening the door 3 partially exposes the four toner cartridges 1.

The door sensor 4 is a switch for detecting whether the door 3 is at an open position (illustrated in FIG. 2A) or a closed position (illustrated in FIG. 2B).

The guide portion 2 is a portion that guides the toner cartridge 1 while the toner cartridge 1 is moved between the supply position X1 and the ejection position Y1. The guide portion 2 extends in the mounting direction M of the toner cartridge 1.

The toner conveyance pipe 8 (toner accommodation unit) is provided with a receiving inlet 8*a* that receives supply of toner from the toner cartridge 1, and forms a conveyance path through which toner conveyed by the toner conveyance screw 10 to the toner conveyance pipe 11 passes. As illustrated in FIG. 2A, when the toner cartridge 1 is at the supply position X1, a supplying outlet 5 is communicated with the receiving inlet 8*a* of the toner conveyance pipe 8. The toner conveyance pipe 11 forms a conveyance path through which toner conveyed by the toner conveyance screw 12 in a vertical upward direction passes, and conveys toner T to the developer container 104. Driving force of the main body driving motor 9 is transmitted to the toner conveyance screw 12 via a spur gear 14*a*, a shaft 14*b*, and a screw gear 14*c*, which constitute the driving unit 14.

The toner cartridge 1 accommodates the toner T inside thereof, and includes the supplying outlet 5 for supplying the toner T to the toner conveyance pipe 8 when the toner cartridge 1 is at the supply position X1, and an accordion-type pump 7.

The pump 7 is configured to be compressed and expanded by a cam 13 that is rotationally driven by driving force of the cartridge driving motor 6 and thereby compress the air. When the toner cartridge 1 is at the supply position X1 as illustrated in FIG. 2A, the pump 7 supplies the toner T to the toner conveyance pipe 8 using the compressed air via the supplying outlet 5 and the receiving inlet 8*a*.

The toner T supplied from the toner cartridge 1 to the toner conveyance pipe 8 is conveyed by the toner conveyance screw 10 driven by driving force of the main body driving motor 9 to the toner conveyance pipe 11. The toner T that has reached the toner conveyance pipe 11 is conveyed in the vertical upward direction by the toner conveyance screw 12 to which the driving force of the main body driving motor 9 is transmitted via the spur gear 14*a*, the shaft 14*b* and the screw gear 14*c*, and is supplied to the developer container 104.

Figure 9:
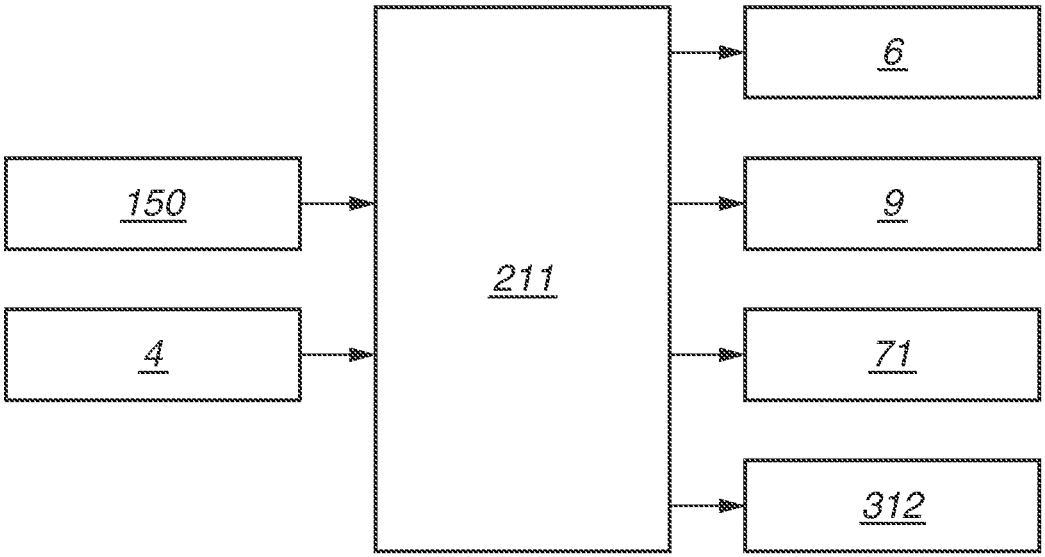
FIG. 9 is a control block diagram according to the first exemplary embodiment.

FIG. 9 illustrates a control block diagram. In a case where supply of toner to the developer container 104 is necessary, a control unit 211 controls driving of the cartridge driving motor 6 and the main body driving motor 9.

(Sensing of Remaining Toner Quantity)

Figure 3:
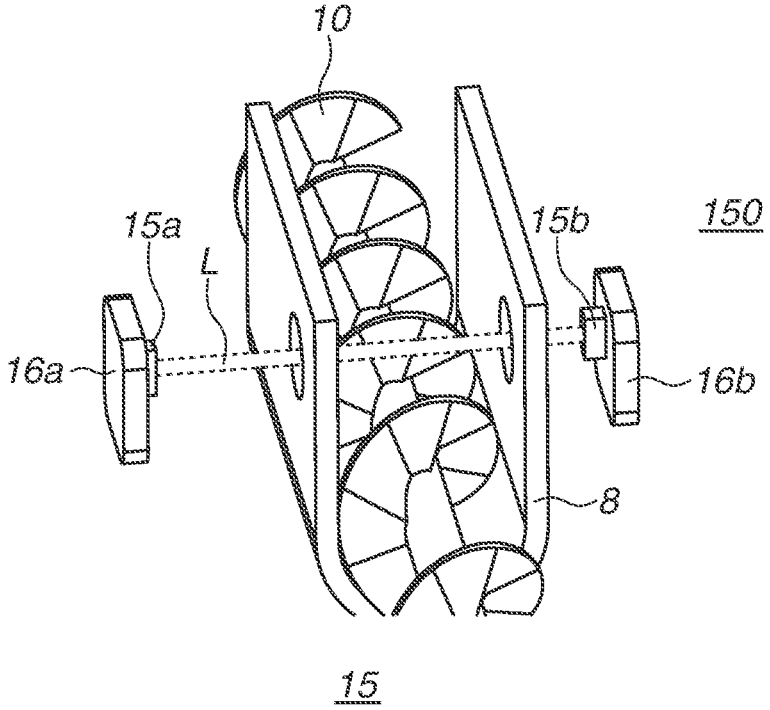
FIG. 3 is a diagram illustrating a toner sensor that senses a state of discharge of toner from the toner cartridge to a toner conveyance pipe according to the first exemplary embodiment.

Sensing of a remaining toner quantity of the toner cartridge 1 is now described. FIG. 3 is a diagram illustrating a toner sensor 150 (toner detection member) for sensing a state of discharge of the toner T from the toner cartridge 1 to the toner conveyance pipe 8. In a case where there is little toner T accommodated in the toner cartridge 1, almost no toner T is discharged from the supplying outlet 5 to the toner conveyance pipe 8. The toner sensor 150 of an optical type arranged in the toner conveyance pipe 8 monitors a state of the toner T discharged from the supplying outlet 5 to the toner conveyance pipe 8 via the receiving inlet 8*a*, and thereby senses (detects) a remaining toner quantity of the toner cartridge 1.

The toner sensor 150 includes a substrate 16*a*, a light-emitting element 15*a* arranged on the substrate 16*a*, a substrate 16*b*, and a light-receiving element 15*b* arranged on the substrate 16*b*. The light-emitting element 15*a* and the light-receiving element 15*b* are arranged so as to face each other with the toner conveyance pipe 8 interposed therebetween. The light-emitting element 15*a* is disposed so as to emit light toward a region in the toner conveyance pipe 8, through which the toner T supplied from the supplying outlet 5 of the toner cartridge 1 passes. The light-receiving element 15*b* is disposed so as to receive light emitted from the light-emitting element 15*a*.

Light-receiving time of the light-receiving element 15*b* is a correlation value correlated to the remaining toner quantity of the toner cartridge 1. In a case where the light-receiving element 15*b* does not receive light emitted from the light-emitting element 15*a* or the light-receiving time is shorter than a predetermined time, light is blocked by toner. In other words, since toner is discharged (supplied) from the toner cartridge 1 to the toner conveyance pipe 8, it can be determined that there is remaining toner. In a case where the light-receiving time of the light-receiving element 15*b* is longer than the predetermined time, light is not blocked by toner. In other words, since toner is not supplied (discharged) from the toner cartridge 1 to the toner conveyance pipe 8, it can be determined that there is little remaining toner.

When determining that there is no remaining toner in the toner cartridge 1 based on a result of sensing by the toner sensor 150, the control unit 211 prompts the user to replace the toner cartridge 1 via a display unit 312 such as an operation panel.

(Extrusion Mechanism for Toner Cartridge)

The apparatus main body 100 includes an extrusion mechanism 99 configured to extrude the toner cartridge 1 from the supply position X1 to the ejection position Y1. In the present exemplary embodiment, the extrusion mechanism 99 extrudes the toner cartridge 1 on condition that it is determined that there is no remaining toner in the toner cartridge 1 based on the result of sensing by the toner sensor 150 and that the door sensor 4 senses an open state of the door 3. Automatic extrusion of the toner cartridge 1 to the ejection position Y1 allows the user to easily recognize which one (ones) of the plurality of toner cartridges 1 (1Y, 1M, 1C, and 1K) should be replaced.

Figure 4A:
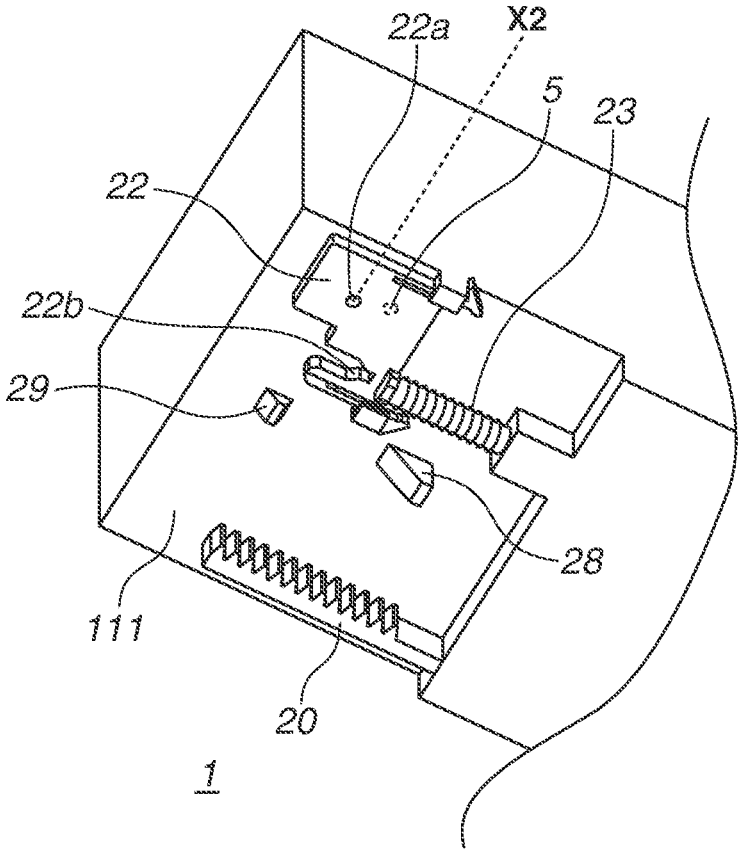
FIGS. 4A and 4B are partial enlarged views each illustrating a neighborhood of a shutter of the toner cartridge according to the first exemplary embodiment.
Figure 4B:
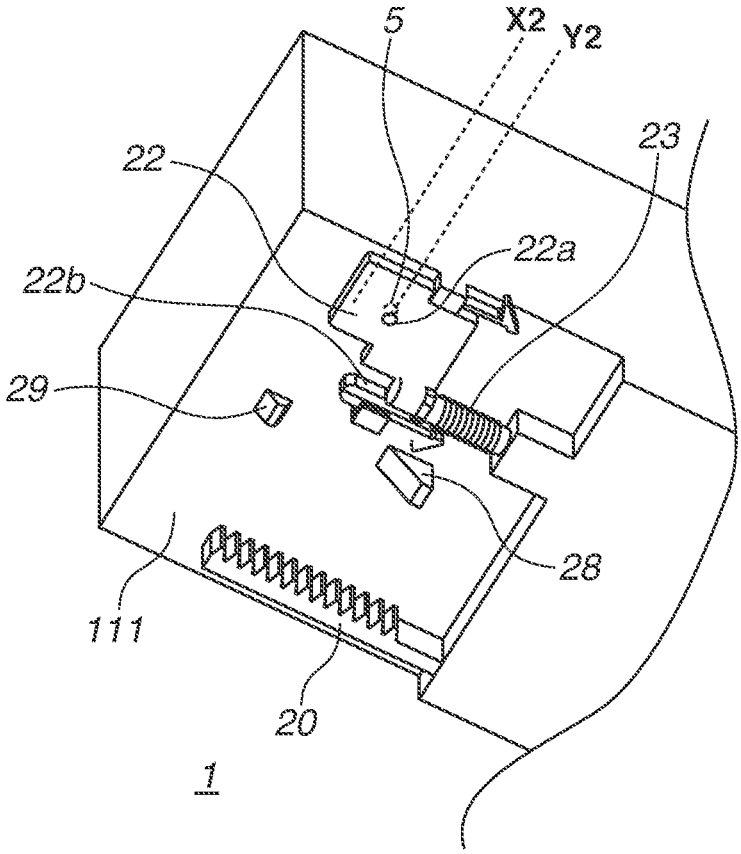

A structure of the toner cartridge 1 with regard to the extrusion mechanism 99 is now described. FIG. 4A is a partial enlarged view illustrating a neighborhood of a shutter 22 of the toner cartridge 1 when the toner cartridge 1 is at the ejection position Y1. FIG. 4B is an enlarged perspective view illustrating the neighborhood of the shutter 22 of the toner cartridge 1 when the toner cartridge 1 is at the supply position X1.

As illustrated in FIGS. 4A and 4B, the toner cartridge 1 includes a toner container 111 that accommodates toner and is provided with the supplying outlet 5, the shutter 22 that is provided with a shutter through-hole 22*a*, a shutter spring 23, a first engaged portion 28, a second engaged portion 29, and a rack portion 20. These components are arranged on a bottom surface of the toner cartridge 1 at an end portion on a downstream side in the mounting direction M.

In FIG. 4A, the shutter through-hole 22*a* of the shutter 22 is at a closed position X2, at which the shutter through-hole 22*a* is not communicated with the supplying outlet 5 of the toner container 111. When the shutter 22 is at the closed position X2, toner is not discharged from the supplying outlet 5 of the toner cartridge 1. When the toner cartridge 1 is moved in the mounting direction M from a state illustrated in FIG. 4A while being guided by the guide portion 2, a recessed portion 22*b* (shutter engaged portion) of the shutter 22 is engaged with a protruded portion 24 (illustrated in FIG. 5A) of the apparatus main body 100, and the shutter 22 is thereby locked. When the toner container 111 is moved in the mounting direction M in a state in which the shutter 22 is locked, the shutter 22 is moved to an open position Y2 with respect to the toner container 111. When the shutter 22 is at the open position Y2, the shutter through-hole 22*a* is communicated with the supplying outlet 5, and consequently, toner can be discharged.

Figure 5A:
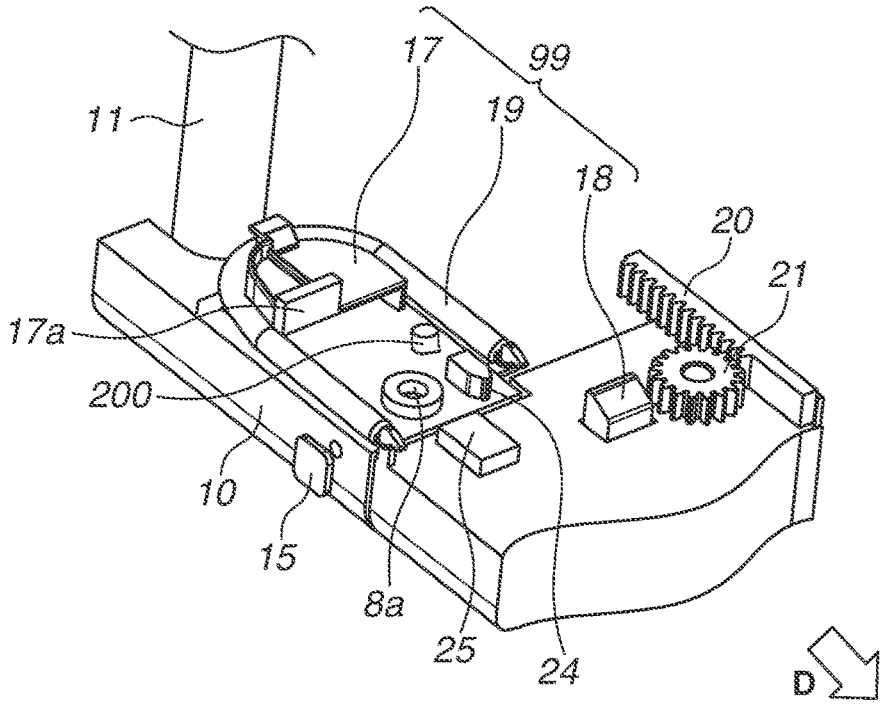
FIGS. 5A and 5B are perspective views illustrating an extrusion mechanism, the toner conveyance pipe, and a braking mechanism according to the first exemplary embodiment when the toner cartridge is at the supply position of the apparatus main body and at the ejection position of the apparatus main body, respectively.
Figure 5B:
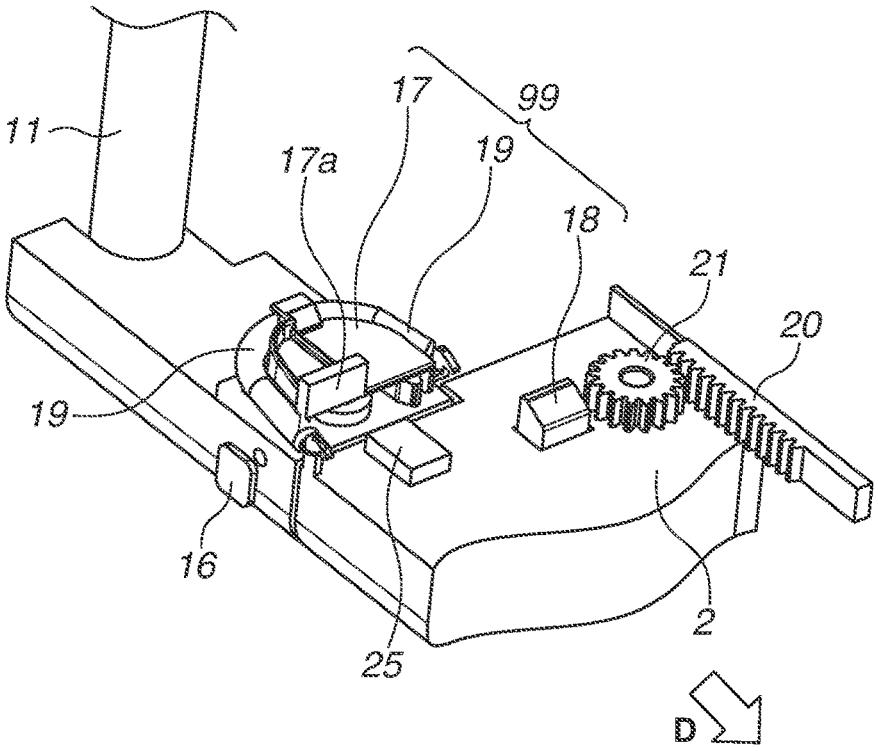

FIG. 5A is a perspective view illustrating the extrusion mechanism 99 of the toner cartridge 1 when the toner cartridge 1 is at the supply position X1 of the apparatus main body 100. FIG. 5B is a perspective view illustrating the extrusion mechanism 99 when the toner cartridge 1 is at the ejection position Y1. In FIGS. 5A and 5B, illustration of the toner cartridge 1 is omitted except for the rack portion 20 for facilitating visualization. The rack portion 20 will be described below.

The extrusion mechanism 99 includes a pressing member 17, a pressing spring 19 (first urging member, first elastic member), and an engaging member 18.

The pressing member 17 includes a pressing portion 17*a* that presses an end surface of the toner cartridge 1 on the downstream side in the mounting direction M so that the toner cartridge 1 is moved from the supply position X1 to the ejection position Y1. The pressing portion 17*a* comes in contact with the end surface of the toner cartridge 1 on the downstream side in the mounting direction M. The pressing member 17 is locked by a stopper 200 before the toner cartridge 1 reaches the ejection position Y1.

The pressing spring 19 is configured to urge the pressing member 17 in the detaching direction D (direction from the supply position X1 toward the ejection position Y1). The toner cartridge 1 is configured to be pressed in the detaching direction D by pressing force (urging force) of the pressing spring 19 via the pressing member 17.

The pressing member 17 also functions as a main body shutter that opens and closes the receiving inlet 8*a* of the toner conveyance pipe 8. The pressing member 17 is at a position where it opens the receiving inlet 8*a* when the toner cartridge 1 is at the supply position X1 as illustrated in FIG. 5A. This allows the receiving inlet 8*a* to receive supply of toner from the supplying outlet 5 of the toner cartridge 1. The pressing member 17 is at a position where it closes the receiving inlet 8*a* when the toner cartridge 1 is at the ejection position Y1 as illustrated in FIG. 5B. The pressing member 17 is maintained in a state of being locked by the stopper 200 by the pressing force of the pressing spring 19.

Figure 6A:
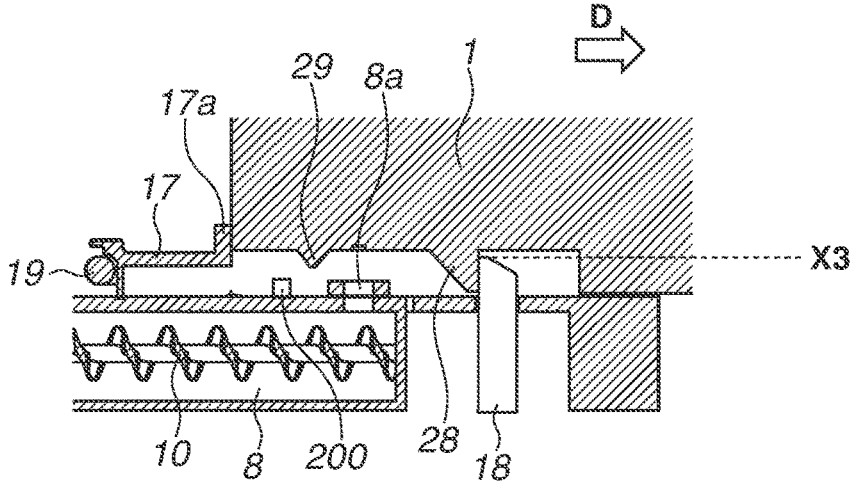
FIGS. 6A, 6B, and 6C are sectional views illustrating the toner cartridge, the extrusion mechanism, and the toner conveyance pipe according to the first exemplary embodiment when the toner cartridge is at the supply position of the apparatus main body, between the supply position of the apparatus main body and the ejection position of the apparatus main body, and at the ejection position of the apparatus main body, respectively.
Figure 6B:
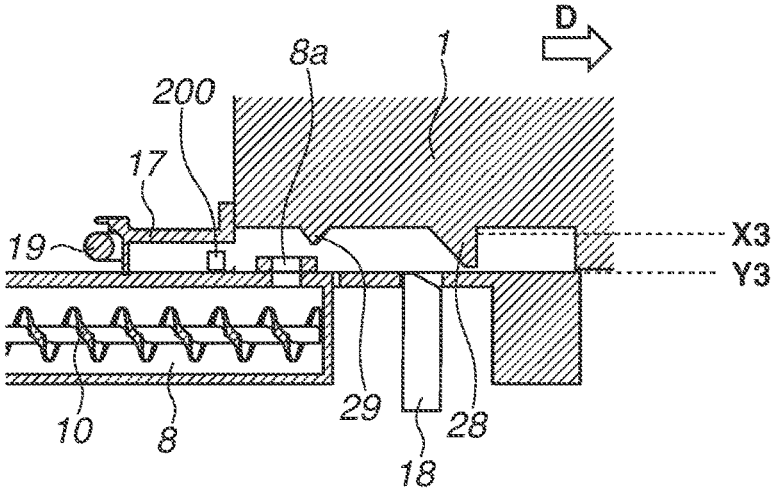
Figure 6C:
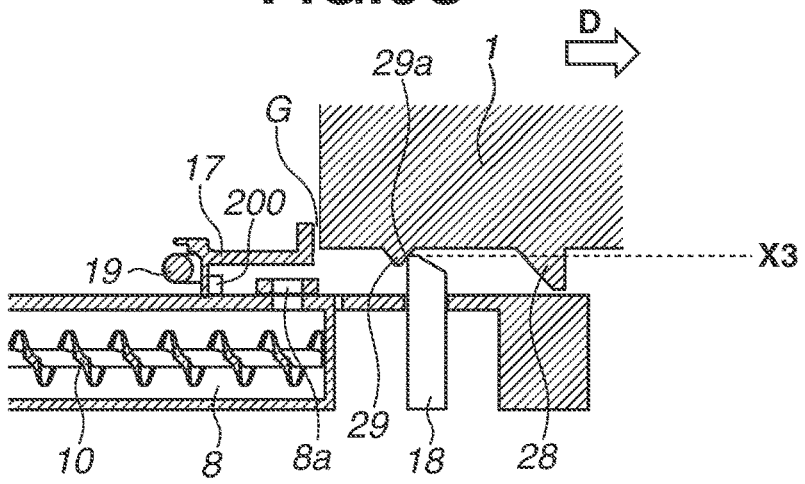

Subsequently, a function of the engaging member 18 that has a function of locking the toner cartridge 1 is described. FIG. 6A is a sectional view illustrating the toner cartridge 1, the extrusion mechanism 99, and the toner conveyance pipe 8 when the toner cartridge 1 is at the supply position X1 of the apparatus main body 100. FIG. 6B is a sectional view illustrating the toner cartridge 1, the extrusion mechanism 99, and the toner conveyance pipe 8 when the toner cartridge 1 is between the supply position X1 of the apparatus main body 100 and the ejection position Y1 of the apparatus main body 100. FIG. 6C is a sectional view illustrating the toner cartridge 1, the extrusion mechanism 99, and the toner conveyance pipe 8 when the toner cartridge 1 is at the ejection position Y1 of the apparatus main body 100.

In FIG. 6A, the engaging member 18 is at an engaging position X3 where the engaging member 18 is engaged with the first engaged portion 28 on the bottom surface of the toner container 111 of the toner cartridge 1 so that the toner cartridge 1 is locked at the supply position X1. When the engaging member 18 is at the engaging position X3, the toner cartridge 1 is locked (movement thereof is restricted) by the apparatus main body 100 so as to prevent the user from ejecting the toner cartridge 1 even if the user opens the door 3. In FIG. 6B, the engaging member 18 is at an engagement release position Y3 where the engagement of the engaging member 18 with the first engaged portion 28 of the toner cartridge 1 is released. This allows the toner cartridge 1 to be pressed by the extrusion mechanism 99 and moved in the detaching direction D. In FIG. 6C, the engaging member 18 is at the engaging position X3 where the engaging member 18 is engaged with the second engaged portion 29 on the bottom surface of the toner container 111 so that the toner cartridge 1 is locked at the ejection position Y1. Since the engaging member 18, having undergone a state illustrated in FIG. 6B, is returned from the engagement release position Y3 to the engaging position X3 before the second engaged portion 29 of the toner cartridge 1 passes by the engaging member 18, the engaging member 18 can be engaged with the second engaged portion 29. When the user pulls out the toner cartridge 1 in the state illustrated in FIG. 6C, the engaging member 18 comes in contact with an inclined plane 29*a* of the second engaged portion 29 on the downstream side in the detaching direction D and is pushed downward. Thus, the user can eject the toner cartridge 1 from the apparatus main body 100.

Figure 7A:
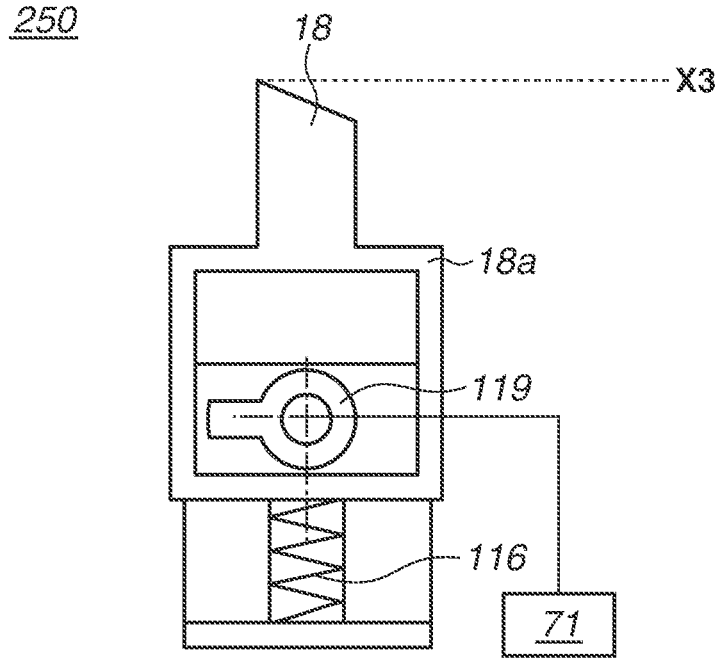
FIGS. 7A and 7B are schematic views illustrating a movement mechanism according to the first exemplary embodiment when an engaging member is at an engaging position and at an engagement release position, respectively.
Figure 7B:
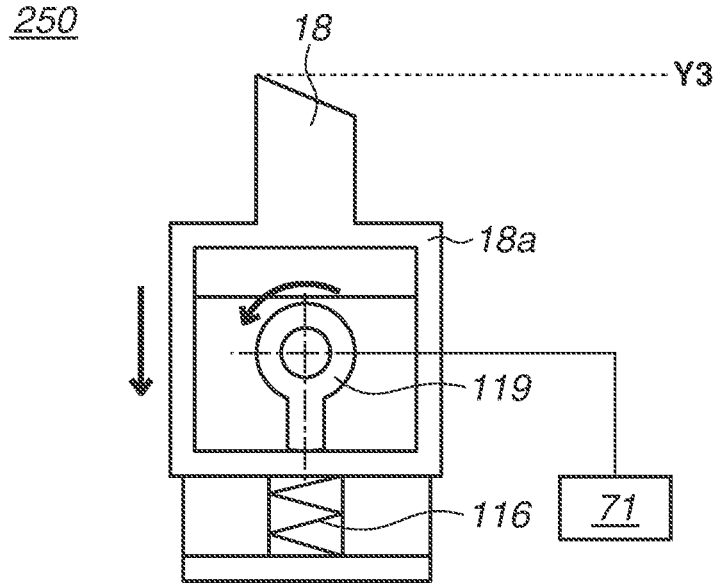

A movement mechanism 250 of the engaging member 18 is now described. FIG. 7A is a schematic view illustrating the movement mechanism 250 when the engaging member 18 is at the engaging position X3. FIG. 7B is a schematic view illustrating the movement mechanism 250 when the engaging member 18 is at the engagement release position Y3. The engaging member 18 is configured to be movable in a direction intersecting the mounting direction M (detaching direction D) of the toner cartridge 1, and includes a cam follower portion 18*a* configured to be engaged with a rotating cam 119 that is rotary driven by a cam motor 71. As illustrated in FIG. 7A, when the engaging member 18 is at the engaging position X3, the rotating cam 119 does not act on the cam follower portion 18*a*, and the engaging member 18 is maintained in a state of being at the engaging position X3 by urging force of a compression spring 116 (second urging member). When the rotating cam 119 is rotated 90° by the cam motor 71, the rotating cam 119 acts on the cam follower portion 18*a*, and the engaging member 18 resists urging force of the compression spring 116 and is moved from the engaging position X3 to the engagement release position Y3. When the rotating cam 119 is rotated 90° again, the cam follower portion 18*a* is released from the rotating cam 119, and the engaging member 18 is moved from the engagement release position Y3 to the engaging position X3 by the urging force of the compression spring 116.

In the present exemplary embodiment, the cam motor 71 is used in the movement mechanism 250, but another actuator such as a solenoid may be used.

(Control of Extrusion Mechanism)

Figure 8:
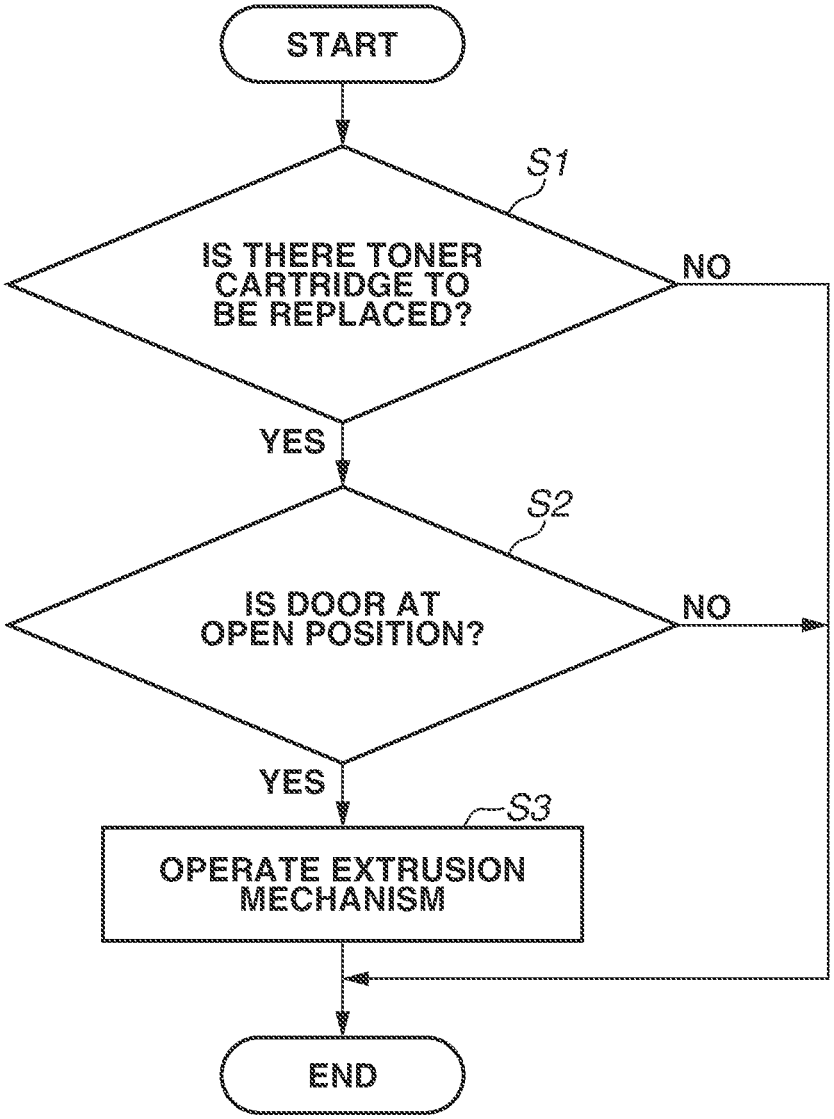
FIG. 8 is a flowchart regarding an operation of the extrusion mechanism for the toner cartridge according to the first exemplary embodiment.

Control of the extrusion mechanism 99 is now described. FIG. 8 is a flowchart regarding an operation of the extrusion mechanism 99. FIG. 9 is the control block diagram.

In step S1, whether there is a toner cartridge 1 to be replaced among the plurality of toner cartridges 1 (1Y, 1M, 1C, and 1K) is determined as illustrated in FIG. 8. Specifically, the control unit 211 illustrated in FIG. 9 determines whether there is a toner cartridge 1 to be replaced based on a result of sensing (result of detection) by the toner sensor 150. In a case where there is a toner cartridge 1 to be replaced (YES in step S1), the processing proceeds to step S2. In step S2, the control unit 211 determines whether the door 3 is at the open position. Specifically, the control unit 211 illustrated in FIG. 9 makes determination based on a result of sensing by the door sensor 4. In a case where the door 3 is at the open position (YES in step S2), the processing proceeds to step S3. In step S3, the control unit 211 operates the extrusion mechanism 99. Specifically, the control unit 211 controls the cam motor 71 to operate the movement mechanism 250 to move the engaging member 18 from the engaging position X3 to the engagement release position Y3. In a case where there is no toner cartridge 1 to be replaced (NO in step S1) or the door 3 is not at the open position (NO in step S2), the control unit 211 does not operate the extrusion mechanism 99.

In the present exemplary embodiment, control is performed to operate the extrusion mechanism 99 in a case where step S1 and step S2 are YES. However, the control is not limited thereto. The control may be performed to operate the extrusion mechanism 99 in a case where step S1 is YES and step S2 is NO. In this case, the movement of the toner cartridge 1 to the second position is restricted by the door 3 when the door 3 is closed, and the toner cartridge 1 is moved to the second position when the door 3 is opened.

(Braking Mechanism)

A braking mechanism, which is a feature of the present exemplary embodiment, is now described. The braking mechanism according to the present exemplary embodiment is a damping force applying mechanism composed of the rack portion 20 arranged in the toner cartridge 1, and a gear damper 21 arranged in the apparatus main body 100. The gear damper 21 is a rotary damper that applies damping force when a pinion gear is rotated, by viscosity of oil or grease. The gear damper 21 generates damping force by engagement of the rack portion 20 of the toner cartridge 1 and the pinion gear with each other while the toner cartridge 1 is moved from the supply position X1 to the ejection position Y1. The damping force becomes larger in proportion to speed of the toner cartridge 1.

Force acting on the toner cartridge 1 when the toner cartridge 1 is being moved in the detaching direction D by receiving pressing force from the pressing member 17 is friction force (in the mounting direction M) applied by the guide portion 2 of the apparatus main body 100, pressing force (in the detaching direction D) applied by the pressing member 17, and damping force of the gear damper 21 (in the mounting direction M).

Application of the damping force by the gear damper 21 prevents collision noise generated when the toner cartridge 1 is extruded by the pressing member 17 and engaged with the second engaged portion 29, and prevents impact applied to the toner cartridge 1. In a case where the impact at the time of extrusion of the toner cartridge 1 is large, toner soiling such as dropping of the toner T adhering to an inner periphery of the shutter through-hole 22*a* to the guide portion 2 of the apparatus main body 100 may possibly occur. Hence, prevention of the impact applied to the toner cartridge 1 when the toner cartridge 1 is extruded is effective in prevention of toner soiling.

Furthermore, in the present exemplary embodiment, the pressing force applied by the pressing member 17 to the toner cartridge 1 becomes smaller from the supply position X1 to the ejection position Y1. The pressing force becomes zero in a period before the toner cartridge 1 reaches the ejection position Y1 and after the pressing member 17 is locked by the stopper 200 of the apparatus main body 100. As illustrated in FIG. 6C, when the toner cartridge 1 is at the ejection position Y1, there is a gap G between the pressing portion 17*a* of the pressing member 17 and an end surface of the toner cartridge 1 on an upstream side in the detaching direction D. In other words, when the toner cartridge 1 is at the ejection position Y1, pressing force by the pressing member 17 does not act on the toner cartridge 1. On the other hand, the gear damper 21 is engaged with the rack portion 20 when the toner cartridge 1 is at both the supply position X1 and the ejection position Y1. The damping force by the gear damper 21 acts on the toner cartridge 1 while the toner cartridge 1 is moved from the supply position X1 to the ejection position Y1. However, as speed of toner cartridge 1 is gradually reduced, the damping force is also reduced accordingly. The speed of the toner cartridge 1 is suddenly reduced at a timing when the pressing member 17 is locked by the stopper 200, and accordingly, the damping force applied by the gear damper 21 is also suddenly reduced. Hence, since the speed of the toner cartridge 1 is reduced by a considerable degree at the ejection position Y1 where the engaging member 18 comes in contact with the second engaged portion 29 of the toner cartridge 1, collision noise and impact are prevented.

Torque of the gear damper 21 is set so that the toner cartridge 1 reaches the ejection position Y1 by receiving urging force of the pressing spring 19 via the pressing member 17. Hence, the toner cartridge 1 extruded by the extrusion mechanism 99 stably stops at the ejection position Y1.

As an incidental effect of the gear damper 21, damping force acts on the toner cartridge 1 also in a case where the toner cartridge 1 is mounted on the apparatus main body 100. As a result, the gear damper 21 plays a role of weakening impact in a case where the user vigorously presses the toner cartridge 1 into the apparatus main body 100. Hence, the prevention of the impact applied to the toner cartridge 1 at the time of mounting of the toner cartridge 1 is also effective in the prevention of toner soiling.

Figure 10:
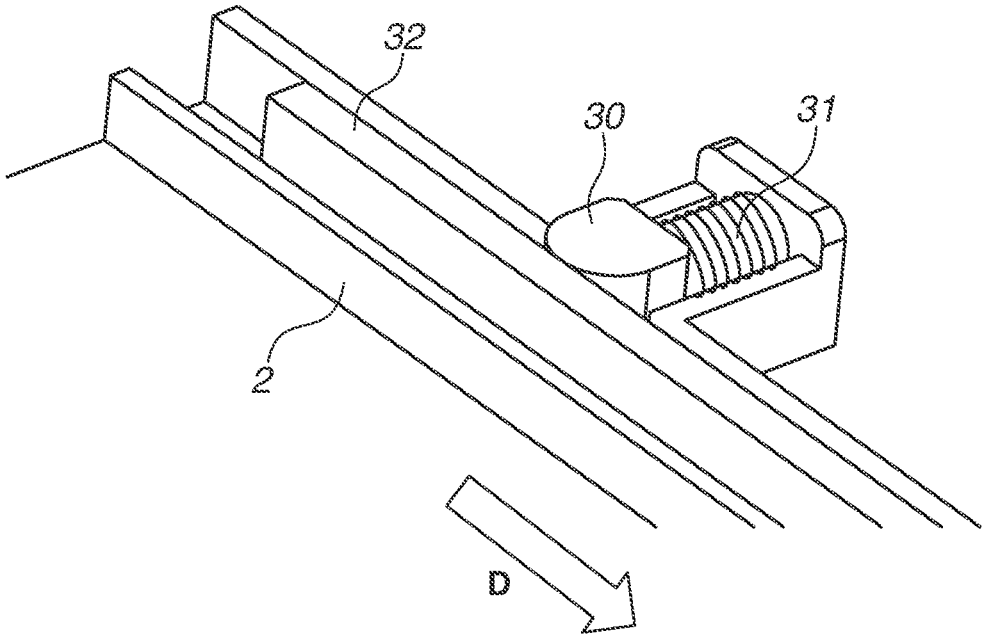
FIG. 10 is a perspective view illustrating a braking mechanism according to a second exemplary embodiment.
Figure 11:
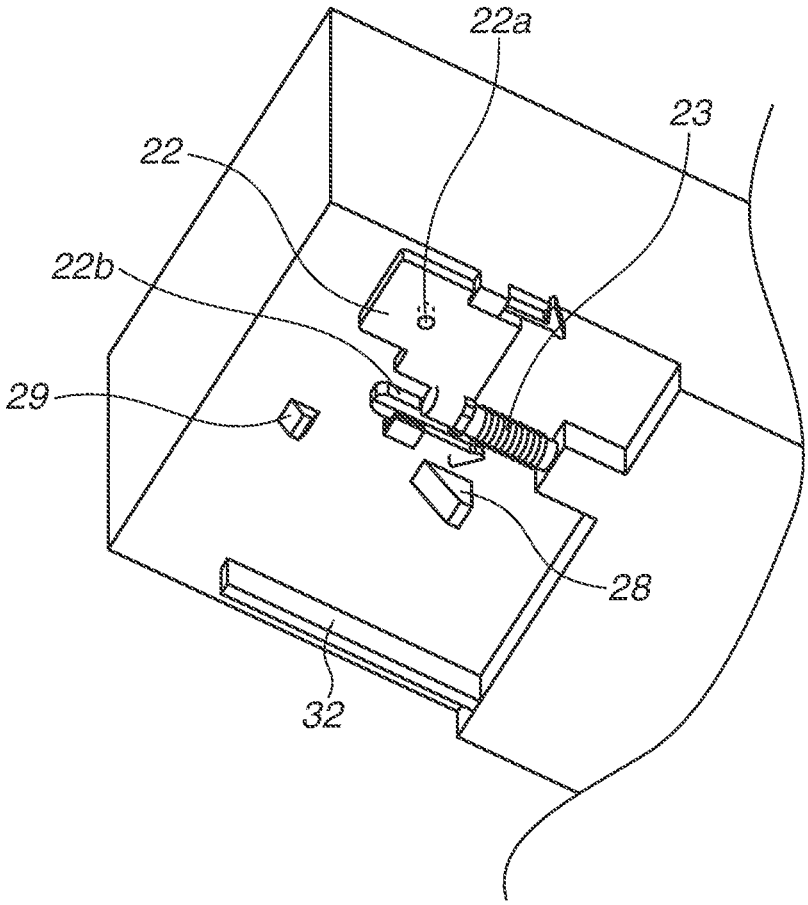
FIG. 11 is an enlarged view illustrating a neighborhood of a shutter of a toner cartridge according to the second exemplary embodiment.

A second exemplary embodiment of the present disclosure is now described. Since the present exemplary embodiment is different from the first exemplary embodiment only in a configuration of a braking mechanism and configurations of other components are the same, a description of the other components is omitted. FIG. 10 is a perspective view illustrating the braking mechanism according to the second exemplary embodiment. FIG. 11 is an enlarged view illustrating the shutter 22 of the toner cartridge 1 according to the present exemplary embodiment.

The braking mechanism according to the present exemplary embodiment includes a rubbing member 30 and a compression spring 31 of the apparatus main body 100 illustrated in FIG. 10, and a rib 32 (rubbed portion) that extends in the detaching direction D of the toner cartridge 1 illustrated in FIG. 11.

The rubbing member 30 is movable in a direction intersecting with the detaching direction D, and is urged by the compression spring 31 so as to come in contact with the rib 32 on the bottom surface of the toner cartridge 1. The rubbing member 30 causes friction force that acts on the toner cartridge 1, and decelerating force is thereby applied to the toner cartridge 1. Unlike the gear damper 21 according to the first exemplary embodiment, the braking mechanism according to the present exemplary embodiment needs not rely on viscosity of grease or oil and is less susceptible to an environmental temperature in which the image forming apparatus 1000 is used. This enables application of stable decelerating force to the toner cartridge 1.

Figure 12A:
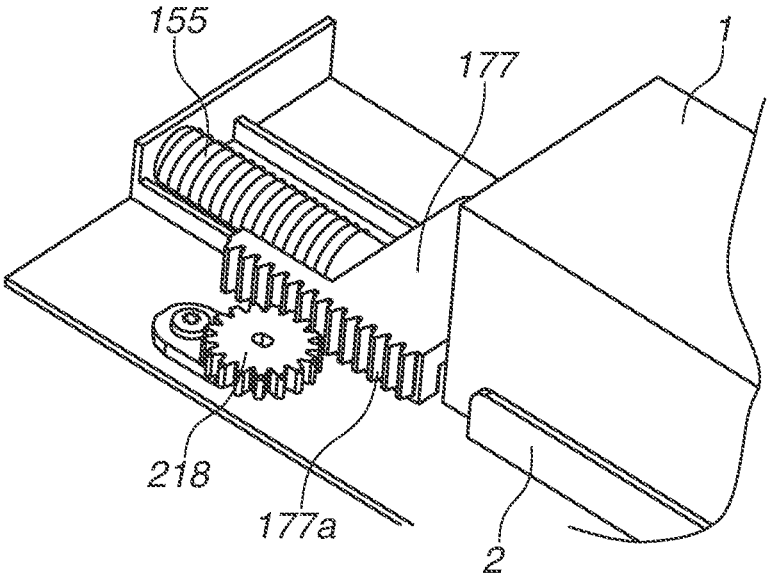
FIGS. 12A and 12B are perspective views each illustrating an extrusion mechanism according to a third exemplary embodiment.
Figure 12B:
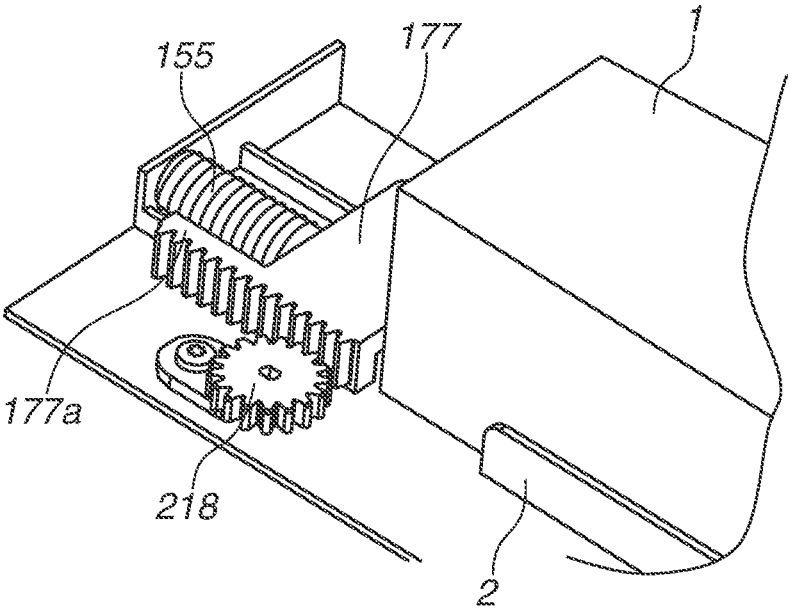

A third exemplary embodiment of the present disclosure is now described. FIG. 12A is a perspective view illustrating an extrusion mechanism according to the present exemplary embodiment. The present exemplary embodiment is different from the first exemplary embodiment in that a pressing member 177 includes a rack portion 177*a*, which is engaged with a gear damper 218. Since configurations of other components of the present exemplary embodiment are the same as those of the first exemplary embodiment, a description of the other components is omitted. The pressing member 177 is a member that presses the toner cartridge 1 to extrude the toner cartridge 1 in the detaching direction D, and is urged by a pressing spring 155 in the detaching direction D. Since the pressing member 177 receives decelerating force from the gear damper 218 while the toner cartridge 1 is moved from the supply position X1 and is locked by the stopper 200, force applied to the toner cartridge 1 by the pressing member 177 is attenuated. As a result, application of damping force by the gear damper 21 to the toner cartridge 1 provides effects of preventing collision noise generated when the toner cartridge 1 is extruded by the pressing member 17 and engaged with the second engaged portion 29, and preventing impact applied to the toner cartridge 1.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-030081, filed Feb. 26, 2021, which is hereby incorporated by reference herein in its entirety.

What is claimed is:

1. An image forming apparatus comprising:

(i) a toner cartridge including:

a toner container configured to accommodate toner, the toner container being provided with a supplying outlet and including an engaged portion; and a shutter configured to be movable with respect to the toner container between an open position where the shutter opens the supplying outlet and a closed position where the shutter closes the supplying outlet;

(ii) an apparatus main body to and from which the toner cartridge can be mounted in an mounting direction and detached in a detaching direction opposite to the mounting direction, the apparatus main body including:

a toner accommodation unit configured to accommodate toner supplied from the supplying outlet of the toner cartridge;

a guide portion configured to guide the toner cartridge to be movable from a first position toward a second position in the detaching direction, the first position being a position where the shutter is at the open position and the toner cartridge is capable of supplying toner from the supplying outlet to the toner accommodation unit, the second position being a position where the shutter is at the closed position, the second position being on a downstream side of the first position in the detaching direction;

a pressing member configured to press the toner cartridge in the detaching direction; and an engaging member configured to be movable between an engaging position where the engaging member is engaged with the engaged portion to restrict movement of the toner cartridge in the detaching direction when the toner cartridge is at the first position and an engagement release position where the engagement of the engaging member with the engaged portion is released, the engaging member being configured to, in a case where the engaging member is at the engagement release position, allow movement of the toner cartridge from the first position toward the second position due to pressing by the pressing member, and (iii) a damping force applying mechanism including a damping force applying member provided in the apparatus main body and configured to apply damping force to the toner cartridge while the toner cartridge is moved from the first position toward the second position.

2. The image forming apparatus according to claim 1, wherein the damping force applying mechanism further includes a rack portion provided in the toner container and extending in the detaching direction, and wherein the damping force applying member is a gear damper configured to be engaged with the rack portion while the toner cartridge is moved from the first position toward the second position.

3. The image forming apparatus according to claim 1, wherein, in a case where the engaged portion is a first engaged portion, the toner cartridge includes a second engaged portion configured to be engaged with the apparatus main body so that the toner cartridge stops at the second position when the toner cartridge is moved from the first position toward the second position.

4. The image forming apparatus according to claim 3, wherein the pressing member is configured not to press the toner cartridge when the toner cartridge is at the second position.

5. The image forming apparatus according to claim 1, wherein the apparatus main body includes an elastic member configured to urge the pressing member in the detaching direction.

6. The image forming apparatus according to claim 3, wherein the second engaged portion is arranged on an upstream side of the first engaged portion in the detaching direction, and wherein after the first engaged portion passes by the engaging member due to a movement of the toner cartridge from the first position toward the second position when the engaging member is at the engagement release position, the engaging member is configured to move from the engagement release position to the engaging position so as to engage with the second engaged portion.

7. The image forming apparatus according to claim 3, wherein the apparatus main body further includes:

a detection member configured to detect a correlation value correlated to a remaining toner quantity of the toner cartridge;

an actuator configured to move the engaging member between the engaging position and the engagement release position; and a control unit configured to control the actuator, the control unit controlling the actuator to move the engaging member from the engaging position to the engagement release position based on a result of detection by the detection member.

8. The image forming apparatus according to claim 1, wherein the damping force applied to the toner cartridge becomes larger in proportion to a movement speed of the toner cartridge.

9. The image forming apparatus according to claim 2, wherein the gear damper is engaged with the rack portion when the toner cartridge is at the first position.

10. The image forming apparatus according to claim 9, wherein the gear damper is engaged with the rack portion when the toner cartridge is at the second position.

11. The image forming apparatus according to claim 10, wherein, in a case where the engaged portion is a first engaged portion, the toner cartridge includes a second engaged portion configured to be engaged with the apparatus main body so that the toner cartridge stops at the second position when the toner cartridge is moved from the first position toward the second position.

12. The image forming apparatus according to claim 4, wherein a pressing force applied to the toner cartridge by the pressing member becomes zero before the toner cartridge reaches the second position.

* * * * *